United States Patent [19]

Welsh

[11] 3,944,310

[45] Mar. 16, 1976

[54] ELECTRONICS CABINET ASSEMBLY

[75] Inventor: James W. Welsh, San Diego, Calif.

[73] Assignee: Langley Corporation, San Diego, Calif.

[22] Filed: Feb. 26, 1975

[21] Appl. No.: 553,447

[52] U.S. Cl. ..... 312/263; 312/257 R; 52/271

[51] Int. Cl.[2] ..... A47B 43/00; A47B 47/00

[58] Field of Search ..... 312/108, 111, 257 R, 263, 312/264, 351; 52/264, 271

[56] References Cited

UNITED STATES PATENTS

| | | | |
|---|---|---|---|
| 2,102,902 | 12/1937 | Lewke | 52/395 |
| 3,353,888 | 11/1967 | Pritelli, Jr. | 312/111 |
| 3,674,328 | 7/1972 | White et al. | 312/263 |
| 3,784,273 | 1/1974 | Nikolai | 312/263 |

*Primary Examiner*—Casmir A. Nunberg
*Attorney, Agent, or Firm*—Brown & Martin

[57] ABSTRACT

A cabinet for high shock and vibration environments such as shipboard use. A pair of side panels are bolted to the deck or other rigid structure. Front, top and back panels are then secured to the side panels through mating surfaces capable of transferring shear forces. The mating surfaces include cooperating tooth forms. The tooth forms have sloping sides that produce a wedging interfitting relationship between the plates and side panels.

8 Claims, 10 Drawing Figures

ELECTRONICS CABINET ASSEMBLY

BACKGROUND OF THE INVENTION

According to the prior art, enclosures, particularly for shipboard installation, are provided in the form of a cabinet having two vertically elongated side panels joined to removable top, bottom, front and rear plates. The cabinets must be strong and rigid when assembled and yet easily disassembled and broken down to a small component size for installation, transportation and storage. When installed, the cabinets are secured to the deck or other rigid structure such that the bottom plate and lower portions of the side panels are not substantially disturbed by induced vibration or other externally induced accelerations. However the central and upper portions of the side panels would be induced to oscillate in a generally horizontally mode in response to vibrational excitation unless sufficiently rigid interconnecting plates are firmly secured between the side panels to prevent such movement.

According to conventional practice, the plates have sufficient rigidity and strength to absorb the forces generated between the opposing side panels. In the usual case, the plates are secured to the side panels with screw type fasteners, such as a bolt received through a bore in the plates and into a threaded bore in the side panels. A combination of friction between the mating surfaces on the plates and panels, together with a close interfitting relationship in the bore between the fastener and plate, is relied upon for the transfer of shear forces between the side panels and plates.

An interconnection system as described above may be satisfactory for relatively low vibrational amplitudes and frequencies. However, it has been found that according to conventional practice it is not possible to satisfactorily sustain a proper stress transfer relationship between the plates and panels undergoing standarized tests above approximately 35 Hertz and acceleration of 3G. Above this frequency and force loading, flat surface metal to metal friction is insufficient and the plate and panel begin to move relatively to one another. Under particularly unfavorable circumstances, these oscillations may increase to the point of damage or destruction to the cabinet itself and are even more likely to damage or destroy the electronics assemblies with the cabinet. The performance of such a cabinet further deteriorates if it has been previously subjected to high shock loadings.

It has been proposed that an improved shear transfer relationship could be developed by precisely milled notches and corresponding projections on the plates and panels, and by the use of precision fitted fasteners. However, such techniques have not proved to be practical because the tolerances required cannot be maintained in the field. Further, precision fit fasteners are expensive to produce and difficult to install and remove.

It is therefore desirable to have a cabinet assembly that transfers the shear force induced by high shock loadings and by vibration at frequencies in excess of 35 Hertz. Such an assembly is particularly desirable if the mating surfaces of the component parts to not require close tolerances and where the parts may be easily assembled and disassembled.

SUMMARY OF THE INVENTION

In an exemplary embodiment of the invention, the aforementioned deficiencies of prior art devices are overcome by a device that transfers shear forces induced by vibrational or other sources at frequencies in excess of 35 Hertz to 50 Hertz and higher by the utilization of a novel mating surface together with a related fastener relationship. The embodiment is described in association with an electronics cabinet. However, it is to be understood that the invention is also applicable to other cabinets and enclosures.

In the exemplary embodiment, a pair of vertically-elongated, generally-rectangular side panels are provided. The side panels are normally assembled to a base plate (bottom plate) and secured to the deck of the ship or other rigid structure by appropriate fasteners. A mating surface is provided along at least a portion of the forward facing edges of the side panels whereby cooperating mating surfaces on one or more front plates may be engaged with the mating surfaces on the side panels to transfer the shear forces generated by vibrations or other induced acceleration between the opposed side panels.

In a typical application, a plurality of front plates are provided extending over the entire height of the cabinet. Accordingly, the mating surfaces on the side panel edges are extended along the entire forward facing edges of both side panels. Further, for purposes of assembly and access to certain types of electronic equipment, the mating surfaces are carried along the upper edges of the side panels and along the rear facing edges.

The mating surfaces include a plurality of parallel, alternating, elongated, protrusions and channels in the mating surfaces of the side panels. There are corresponding elongated protrusions and channels on the front, top and rear plates. The protrusions and channels on the plates are laterally staggered from those on the side panels so that the protrusions on the plates are received in channels on the side panels and the protrusions on the side panels are received in channels on the plates. The engagement of the protrusions and channels produces an interfitting relationship, and an engagement, between opposing protrusions and channels, so that a physical interfitting relationship is created for the transfer of shear forces.

The use of a tooth form, such as an Acme tooth form, with sloping sides has particular advantages as used in the cabinet assembly of the invention. Such a tooth form may be economically produced on the mating surfaces by conventional milling techniques. The cooperation of the sloping surfaces of opposed protrusions and channels produces a wedging interaction between the plate and side panels and compensates for minor manufacturing tolerances.

The mating surfaces on the plates are held in the interfitting relationship with the mating surfaces on the side panels by one or more fasteners connecting between each plate and each side panel. The purpose of the fasteners is to promote and maintain the interfitting relationship. The fastener is not relied upon for the direct transfer of shear forces. Accordingly, the bore through the plates and the threaded bore in the side panels need not meet close tolerances.

It has been discovered that the capability of the plates and panels for transferring shear forces may be enhanced by angulating the mating surfaces. The angulation of the mating surfaces relative to the plane of the plates produces an increased projected area over which the shear forces may be absorbed in the panels and plates.

It is therefore an object of the invention to provide a new and improved electronics cabinet assembly.

It is another object of the invention to provide a new and improved electronics cabinet assembly that withstands high frequency vibrational loading.

It is another object of the invention to provide a new and improved electronics cabinet assembly that does not require close manufacturing tolerances.

It is another object of the invention to provide a new and improved electronics cabinet assembly that is not dependent upon precise installation procedures.

It is another object of the invention to provide a new and improved electronics cabinet assembly that does not require the incorporation of precision fasteners.

It is another object of the invention to provide a new and improved electronics cabinet assembly that reduces manufacturing cost.

It is another object of the invention to provide a new and improved electronics cabinet assembly that reduces the time required to obtain access to the interior of the cabinet.

It is another object of the invention to provide a new and improved electronics cabinet assembly that has a high overall strength and resistance to exteriorly generated loadings.

It is another object of the invention to provide a new and improved electronics cabinet assembly that may be broken down to a small component size for transportation, installation and storage.

Other objects and many attendant advantages of the invention will become more apparent upon a reading of the following detailed description, together with the drawings, in which like reference numerals refer to like parts throughout, and in which:

DETAILED DESCRIPTION OF THE DRAWINGS

Figure 1:
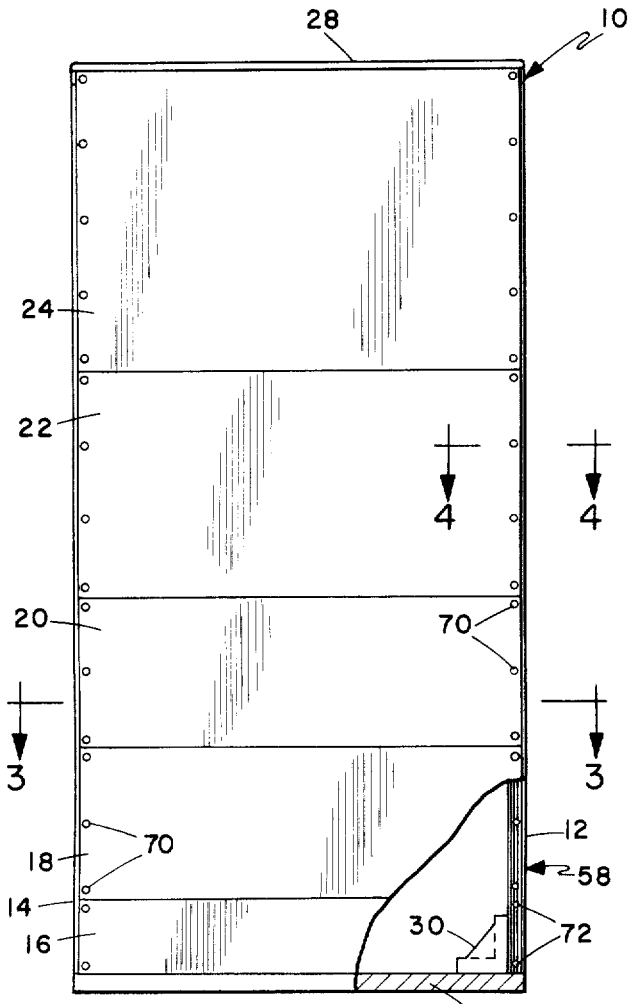
FIG. 1 is a front view, partially cut away, of a typical cabinet incorporating the novel structure of the invention.
Figure 2:
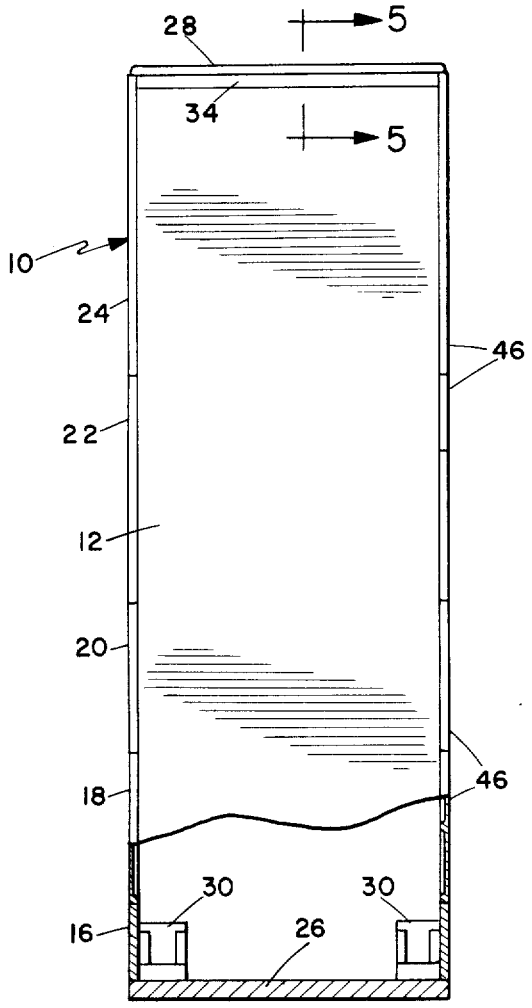
FIG. 2 is a side elevation view of the cabinet, with a portion cut away.

Referring now to the drawings, there is illustrated an electronics cabinet assembly 10 according to the invention. The cabinet is comprised of a pair of right and left side panels 12 and 14. Side panels 12 and 14 are joined, by a plurality of interconnecting brace brackets 30, directly to supporting structure, such as the deck of a ship, by bolts (not shown) passing through the brackets 30 and base plate 26.

The front of the cabinet assembly is completed by a plurality of front plates 16, 18, 20, 22 and 24. A plurality of similar plates 46 enclose the rear of the cabinet and a top plate 28 encloses the upper portion of the cabinet. The plates incorporate lightening recesses, such as recess 40 in plate 20.

Figure 3:
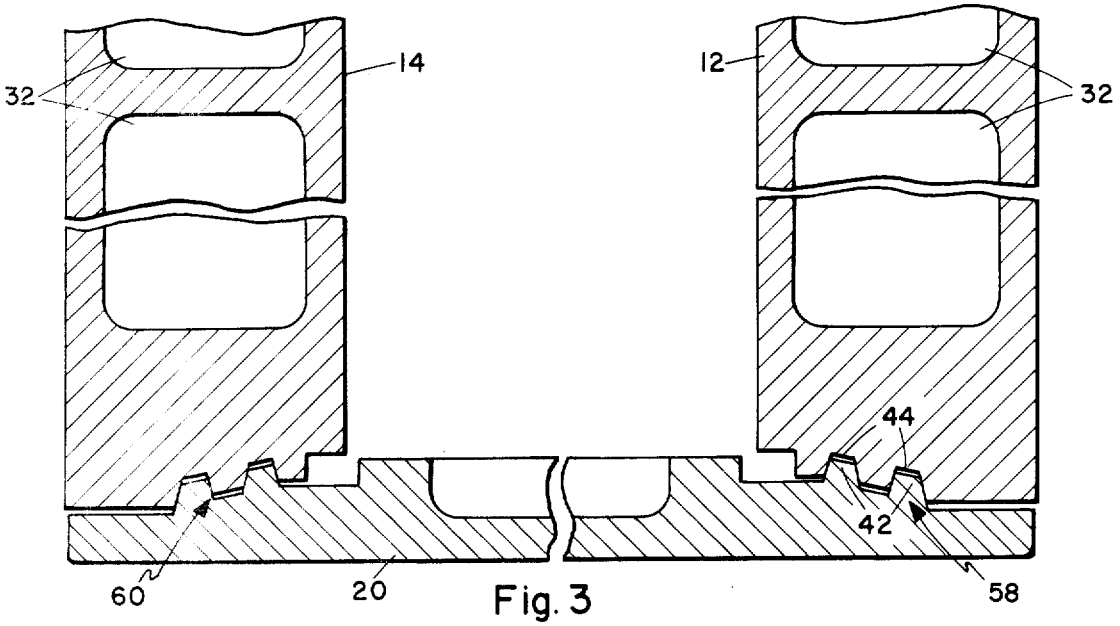
FIG. 3 is an enlarged sectional view taken on line 3—3 of FIG. 1.
Figure 5:
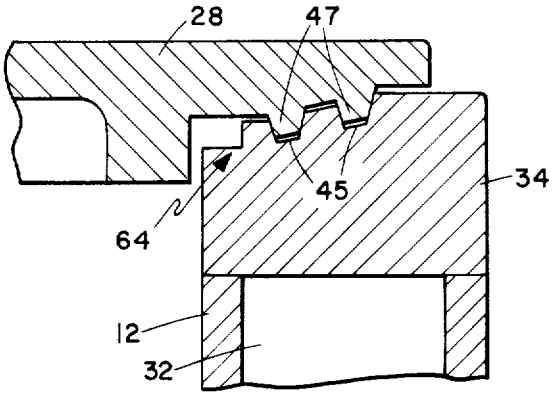
FIG. 5 is an enlarged sectional view taken on line 5—5 of FIG. 2.
Figure 6:
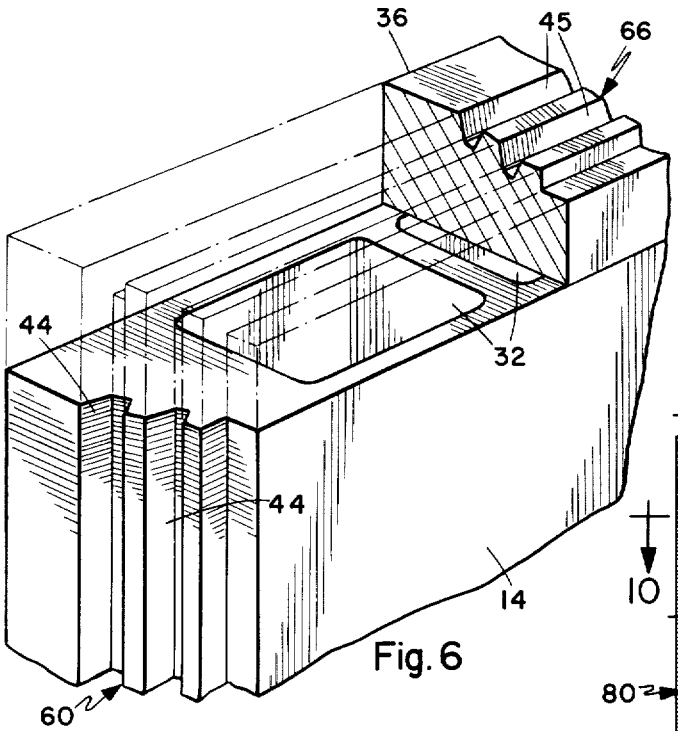
FIG. 6 is a perspective view, partially cut away, of a corner of the cabinet side wall showing the tooth configuration.

Referring now particularly to FIGS. 3, 5 and 6, the detailed configuration for the end plates 12 and 14 is illustrated. The end plates 12 and 14 comprise extrusions incorporating a plurality of vertically extending openings 32. The openings 32 lighten the structure and provide for functions, such as the transport of cooling air between the upper and lower portions of the cabinet. A end cap 34 is welded or otherwise secured to the upper terminal edge of side panel 12. A corresponding end cap 36 is secured to the upper edge of side panel 14. The end caps 34 and 36 incorporate cooperating mating surfaces 64 and 66 to be described more fully hereinafter.

The forward and rearward mating surfaces on the side panels 12 and 14 contain mating structure corresponding to that illustrated in association with the front mating surfaces 58 and 60 in FIG. 3. The mating surface 58 is typical and incorporates a plurality of channels 44 which cooperate with corresponding tooth forms 42 on the front plate 20. The sides of the tooth form and the corresponding channels converge at an included angle of 24° so as to provide for a wedging interfitting relationship. The 24° angulation maximizes the wedging action that can be obtained without seizing. The depth of these channels 44 is sufficient so that the tooth form 42 does not bottom out in the channel and insures a firm engagement contact between the tooth form 42 and both sides of the channels 44. The mating surface 58 is oriented at an angle to the general plane of the front plate 20 so that lateral shear forces transfered from the side panel 12 to the front plate 20 are transfered by the booth forms 42 to portions spaced throughout the depth of plate 20.

It will be noted, particularly by reference to FIG. 6, that the channels 44 continue to the upper terminal portion of the side panels, such as the side panel 14 thereillustrated, and that the channels 44 further continue into the end cap 36. A pair of horizontal parallel channels 45 mate with the channels 44 in the end cap and extend across the length of the end caps 34 and 36 to produce a corresponding interfitting relationship with tooth forms on the top plate 28. The relationship between the top plate 28 and the end caps 34 and 36 is best illustrated in FIG. 5. FIG. 5 illustrates the forms 47 in engagement with horizontal channels 45 in the end cap 34.

It will be understood that the rear plates 46 engage with mating surfaces on the side panels 12 and 14 in a manner that is comparable to that illustrated for the front plates in FIG. 3.

Figure 4:
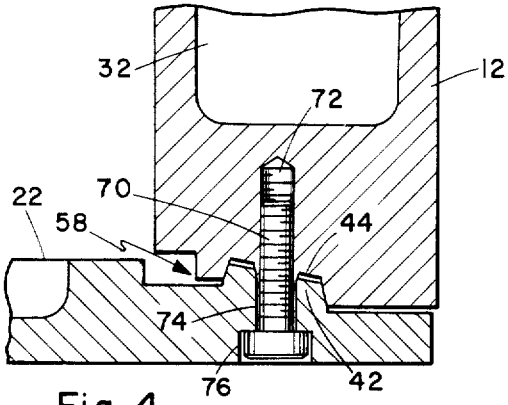
FIG. 4 is an enlarged sectional view taken on line 4—4 of FIG. 1.

Referring now to FIG. 4, the use of a fastener in association with the mating surfaces is illustrated. A bolt 70 is received in an unthreaded bore 74 through the front plate 22 and passes into a threaded bore 72 in the side panel 12. The head of the bolt 70 is received in a recess 76 in panel 22. Thus, bolt 70 is utilized to draw the panel 22 into a wedging interfitting frictional relationship between the tooth forms 42 and channels 44, and for the purpose of maintaining the plate 22 in such interfitting relationship under the application of stresses including vibrational loading. It will be noted that the tooth forms 42 are guided into the corresponding channels 44, by the converging sides thereof, despite any minor misalignment such as may be produced by manufacturing tolerances. The bolt 70 is effective to draw the plate 22 into firm wedging interfitting relationship despite such minor misalignment.

Figure 7:
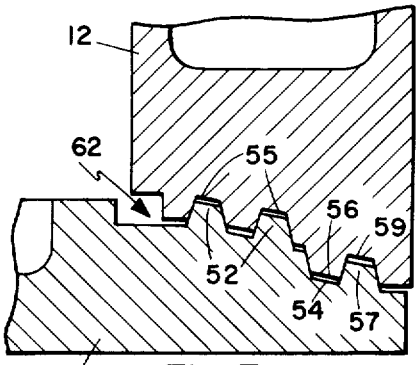
FIG. 7 is a sectional view similar to a portion of FIG. 3, showing an alternative multiple tooth arrangement.

The use of a different mating surface configuration is illustrated in FIG. 7. Mating surfaces 62 are shown to comprise two tooth forms 52, on a front panel 53, engaging channels 55 on the side panel 12. Adjacent to the tooth forms 52, there is a channel 54 for the receipt of a tooth form 56 on side panel 12. Finally there is a tooth form 57 on the plate 52 which cooperates with a channel 59 on side panel 12. Thus the invention is not limited to an application with a particular tooth form-channel pattern but rather any combination of channels and tooth forms that produces at least two interfitting relationships will be effective to substantially increase the shear strength and ability to transfer vibrational loading.

Figure 8:
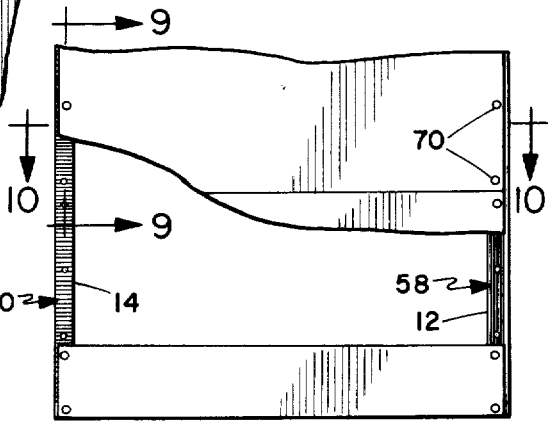
FIG. 8 is a front view, partially cut away, of an alternative cabinet structure.
Figure 9:
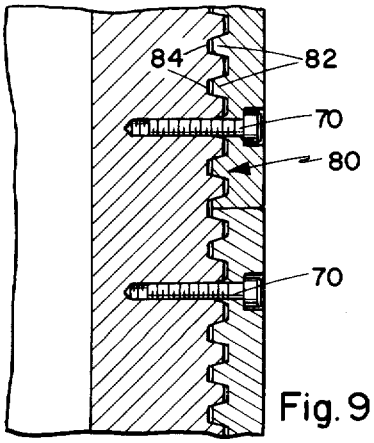
FIG. 9 is an enlarged sectional view taken on line 9—9 of FIG. 8.
Figure 10:
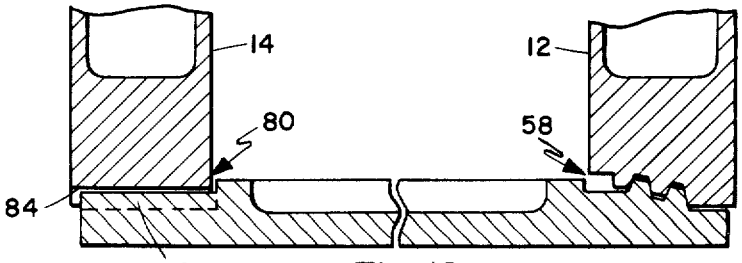
FIG. 10 is an enlarged sectional view taken on line 10—10 of FIG. 8.

A further modified form of the invention is illustrated in FIGS. 8 through 10. The instant modification has particular application where ease of disassembly and assembly is paramount. The right hand mating surfaces 58 are identical to those illustrated in FIG. 3. However, the left hand mating surfaces 80 are comprised of a series of tooth forms and channels 82 and 84 which are oriented at right angles to the corresponding tooth forms and channels in the right hand mating surfaces 58. The shape and interfitting relationship of the tooth forms with the channels is identical to that in the right hand mating surfaces 58, however the transverse orientation of the tooth forms and channels 82 and 84 permits maximum ease in assembly and completely eliminates any critical tolerances in the assembly of parts. In the configuration according to FIGS. 8 through 10, the user may first align the mating surfaces 58 without reference to the mating surfaces 80 since the mating surfaces 80 will accommodate a wide tolerance in final positioning. Despite the fact that the tooth forms and channels 82 and 84 are generally parallel to the primary excursions that would be induced by vibratory loading, they are effective to transfer shear forces. It will be recognized that, since the lower terminal portion of the side panels is rigidly secured to the deck or other supporting structure, any movement of the side panels spaced from the base portion will include some translation and some rotation. The wedging interfitting relationship effected by the mating surfaces 58 substantially eliminates any rotation capability for the opposite terminal edge of the front plates and provides a high mechanical advantage in clamping force. Therefore, the mating surfaces 80 prevents any sqewing or rotation of the panel 14 and thereby transfers shear forces between the front plates and side panels.

Having described my invention, I now claim:

1. A cabinet assembly comprising:

a pair of side panels, said side panels being generally planar and adapted for vertically upright and parallel mounting, said side panels being adapted to be secured together in spaced apart relationship by being secured through the upper and lower ends thereof, said side panels having a mating surface along at least a portion of the forward facing edges thereof, at least one generally planar front plate, said front plate being adapted for extending between spaced side panels and having spaced mating surfaces adapted to cooperatively engage said mating surfaces on said side panels, said mating surface collectively having a plurality of parallel elongated protrusions and alternate parallel channels, said protrusions having sloping sides converging toward the outer portions of said protrusions, fastener means adapted for being received on said front plate and said side panels for drawing opposing protrusions and channels into a wedging interfitting engagement so that vibrationally induced shear forces are transferred between said front plates and said side panels through the engaged protrusions and channels.

2. The cabinet assembly according to claim 1 wherein;

said side panels have mating surfaces along substantially the entire forward facing edges thereof, and a plurality of planar front plates being adapted to be secured between mating surfaces of said side panels at vertically spaced portions of said side panels.

3. The cabinet assembly according to claim 2 wherein;

said mating surfaces on said side panels extend along the upper horizontal edges of said side panels.

4. The cabinet assembly according to claim 3 wherein;

said mating surfaces extend along substantially the entire rearward facing edges of said side panel.

5. The cabinet assembly according to claim 1 wherein;

said plurality of parallel elongated protrusions on a first of said mating surfaces are at right angles to said plurality of parallel elongated protrusions on the second of side panels.

6. The cabinet assembly according to claim 1 wherein;

said sides of said protrusions converge at an included angle of approximately 24°.

7. The cabinet assembly according to claim 1 wherein;

said fastener means comprise a plurality of fastener elements in each of said front plates;

said fastener elements being received through said front plates and into said side panels through the cooperating mating surfaces thereof.

8. The cabinet assembly according to claim 1 wherein;

said mating surfaces on said front plate extend at an angle to the general plane of said front plate to produce the minimum thickness of said front plate at the outermost portions thereof.

* * * * *